US005377697A

United States Patent [19]

Deutsch et al.

[11] Patent Number: 5,377,697

[45] Date of Patent: Jan. 3, 1995

[54] CIGARETTE FILTER TEST APPARATUS AND ASSOCIATED METHOD FOR MEASURING FILTER HOT COLLAPSE AND TOBACCO CONSUMPTION

[75] Inventors: Lance J. Deutsch, Charlotte; Pamela D. Park, Lake Wylie, both of S.C.; George Trail, McMinnville, Tenn.

[73] Assignee: Hoechst Celanese Corporation, Somerville, N.J.

[21] Appl. No.: 113,539

[22] Filed: Aug. 27, 1993

[51] Int. Cl.[6] ..... A24C 5/00

[52] U.S. Cl. ..... 131/330; 131/905; 73/78; 73/81

[58] Field of Search ..... 131/330, 905; 73/78, 73/81

[56] References Cited

U.S. PATENT DOCUMENTS 4,227,400 10/1980 Nienow et al. ..... 73/81
4,333,333 6/1982 Pangritz .
4,400,972 8/1983 Wiethaup .
4,820,051 4/1989 Yanagisawa et al. ..... 73/81 X
5,117,845 6/1992 Poulet et al. ..... 131/330

*Primary Examiner*—Jennifer Bahr
*Attorney, Agent, or Firm*—R. H. Hammer, III

[57] ABSTRACT

A test apparatus includes an optical displacement transducer for sensing deformation of the cigarette filter responsive to a predetermined load applied transverse to the filter during simulated smoking of the cigarette, and a barcode laser scanner for sensing relative movement of a charline along a tobacco rod of the burning cigarette during simulated smoking. The optical displacement transducer thus produces a filter hot collapse signal, while the barcode laser scanner produces a tobacco consumption signal. A processor, such as a microprocessor operating under stored program control, samples the hot collapse signal and the tobacco consumption signal to generate a series of respective data points. A display is operatively connected to the processor for generating a graphical representation of at least one of the hot collapse signal and the tobacco consumption signal as a function of time, based upon the respective sampled data points.

22 Claims, 3 Drawing Sheets

CIGARETTE FILTER TEST APPARATUS AND ASSOCIATED METHOD FOR MEASURING FILTER HOT COLLAPSE AND TOBACCO CONSUMPTION

FIELD OF THE INVENTION

The invention relates to the field of test apparatus for cigarettes, and more particularly, to a tester and associated method for cigarette filters.

SUMMARY OF THE INVENTION

The hardness or firmness of a cigarette filter is a significant indicator of the quality of the cigarette. Smokers generally prefer a filter which substantially retains its hardness, and therefore its shape, during smoking. The effectiveness of the filter may also suffer should the filter collapse during smoking. In addition, a relatively hard filter rod, from which individual filters are cut, is more easily handled during the manufacturing of cigarettes.

A typical cigarette filter is formed of cellulose acetate filaments and includes certain additives which cause bonding of adjacent or intersecting portions of the cellulose acetate filaments. Thus, a predetermined initial or "cold" hardness for the filter may be obtained by selecting the desired additives and applying them in desired quantities. However, during smoking "hot collapse", occurs. In other words, smoke condensate and other factors cause the fibers to soften leading to a loss in hardness of the filter. This hot collapse is readily perceived to be a sensory defect by the smoker, and is particularly noticeable over the last few puffs of a cigarette when the hot collapse is greatest.

An increase in additives to enhance the "cold hardness" of a filter tends to increase the problem with hot collapse during smoking. (See, for example, report entitled *RHODIA Hardness-Tester HDS*-4, by Rhodia AG of Freiburg West Germany, (1983)). Accordingly, it is important for a manufacturer to be able to determine the optimum additive amount for each type of filter. In addition, the hot collapse is strongly influenced by the moisture content of the tobacco rod. Yet other factors which influence hot collapse are the filament denier of the cellulose acetate, the total denier or density of the packing of the filaments in the filter, and the residual crimping of the filaments.

Several manufacturers have developed test equipment for measuring the hot collapse of a cigarette filter during simulated smoking. For example, Rhodia AG has developed a hot collapse tester identified under the model designation HDS-4. The tester includes a holder for maintaining the cigarette in a conventional horizontal position during the test. A mechanical linkage and counterbalancing weight cooperate with a stamp to provide a compressive load downwardly onto the filter during simulated smoking of the cigarette. An inductive transducer measures movement of a shaft connected to the stamp to thereby measure the hot collapse of the filter. A single channel smoking machine with a 35 ml bell-shaped puff volume simulates the smoker's puffing action with a series of spaced apart puffs during the testing. The output signal of the inductive transducer is fed to a processor which, in turn, may display the data in graphical form or print a hard copy of the measured data. In particular, the deformation or collapse may be plotted on the ordinate as a function of time and/or the periodic smoking puffs. After about ten puffs, for example, the cigarette would typically be exhausted and the test terminated.

In view of the importance for measuring hot collapse, particularly with respect to its importance relating to consumer perceived quality, a cigarette hot collapse task force was formed composed of members of the CORESTA Smoke & Technology Groups (hereafter "Task Force"). The Task Force offered several recommendations for a proposed test instrument to meet the needs for accuracy and repeatability in measuring hot collapse of cigarette filters. The Task Force recommended that tobacco consumption also be measured during measurement of hot collapse. The Task Force further recommended that an infrared detector be used to determine when the charline reaches a predetermined point along the tobacco rod so that the hot collapse could be measured at that point.

Unfortunately, conventional hot collapse testers, such as the HDS-4, lack the capability to measure tobacco consumption during testing. Moreover, such conventional testers include relatively complex mechanical linkage arrangements to measure the deformation of the filter. Accordingly, these testers require significant set up time and may further suffer from accuracy and repeatability problems during testing.

SUMMARY OF THE INVENTION

In view of the foregoing background, it is therefore an object of the present invention to provide a method and test apparatus for measuring hot collapse of a cigarette filter that produces accurate and repeatable measurements.

It is another object of the present invention to provide a method and test apparatus for measuring hot collapse of a cigarette filter and for accurately measuring tobacco consumption concurrently with the measurement of hot collapse.

These and other objects, features, and advantages of the present invention are provided by a test apparatus including hot collapse sensing means for sensing deformation of the cigarette filter responsive to a predetermined load applied transverse to the filter during simulated smoking of the cigarette, and tobacco consumption sensing means for sensing relative movement of a charline along a tobacco rod of the burning cigarette during simulated smoking. The hot collapse sensing means generates a hot collapse signal based upon the sensed deformation, while the tobacco consumption sensing means generates a tobacco consumption signal based upon the sensed relative movement of the charline.

More particularly, the tobacco consumption sensing means preferably includes laser transmitter means for generating a laser beam, scanning means for scanning the laser beam along a length of the cigarette, and receiver means for detecting a reflected portion of the scanned laser beam from the cigarette. Laser shield means is preferably positioned adjacent the cigarette holder opposite the laser transmitter means for shielding an accidental or unintended observer from the laser beam. While the laser power is relatively low and the beam is a moving rather than stationary beam, the shield further serves to ensure personnel safety.

The tobacco consumption sensing means may be provided by a conventional laser bar code scanner. Accordingly, the charline functions as a contrasting indicia to the cigarette paper, thus permitting the bar code scanner to accurately sense tobacco consumption and generate a relatively large number of closely spaced data points during the test. As would also be appreciated by those having skill in the art, the tobacco consumption sensing means may also have application in other cigarette testing applications in addition to measuring hot collapse of cigarette filters.

The test apparatus also includes a cigarette folder and smoking means for drawing air through a burning cigarette positioned in the cigarette holder to simulate smoking of the cigarette. The cigarette holder preferably includes means, such as an arcuately shaped shoe, for supporting an underside of the cigarette filter to hold the cigarette in a generally horizontal orientation. As would be readily understood by those skilled in the art, the smoking means preferably includes a pump and means for operating the pump to produce a predetermined series of simulated smoking puffs.

The test apparatus also preferably includes a processor, such as a microprocessor operating under stored program control, operatively connected to the hot collapse sensing means and the tobacco consumption sensing means. The processor may sample the hot collapse signal and the tobacco consumption signal to generate a series of respective data points. Display means is preferably operatively connected to the processor for generating a graphical representation of at least one of the hot collapse signal and the tobacco consumption signal as a function of time, based upon the respective sampled data points. The collected data may also be displayed in a tabular format or printed in either graphical or tabular form, as would be readily understood by those skilled in the art.

The hot collapse sensing means preferably includes stamp means positioned adjacent the cigarette holder for providing the predetermined load transverse to the cigarette filter during simulated smoking. The stamp means preferably includes a generally cylindrical stamp for bearing upon the cigarette filter, a shaft connected to the stamp, means for supporting the shaft so that the stamp is movable in a generally vertical direction downward upon the cigarette filter, and bias means connected to the shaft for providing the predetermined load through the stamp and to the cigarette filter.

Another feature of the present invention is that the test apparatus preferably includes an optical displacement transducer to sense deformation of the filter. The optical displacement transducer may be of a conventional type including an optical transmitter for transmitting an optical beam toward a reflector carried by the shaft of the stamp means, a photodetector or optical receiver for collecting a portion of the optical beam reflected from the reflector, and means for generating a signal related to displacement of the reflector. Thus, a highly accurate measurement of deformation of the filter during simulated smoking may be obtained. Stated in other words, the optical displacement transducer of the present invention reduces the need for the complex mechanical linkages and eliminates the need for a relatively inaccurate inductive displacement transducer as in the HDS-4 tester and similar conventional testers.

A method of the present invention is for testing hot collapse of a cigarette filter during simulated smoking of a cigarette. The method includes the steps of: positioning a cigarette in a holder and drawing air through the burning cigarette to thereby simulate smoking of the cigarette; sensing deformation of the cigarette filter responsive to a predetermined load applied transverse to the filter during simulated smoking of the cigarette and generating a hot collapse signal based upon the sensed deformation; and sensing relative movement of a charline along a tobacco rod of the burning cigarette during simulated smoking. The relative movement of the charline is sensed by generating a laser beam, scanning the laser beam along a length of the cigarette, and detecting a reflected portion of the scanned laser beam from the cigarette to thereby generate a tobacco consumption signal based upon the sensed relative movement of the charline.

The method also preferably includes the step of generating a graphical representation of at least one of the hot collapse signal and the tobacco consumption signal as a function of time. The step of drawing air through the burning cigarette preferably includes the step of operating a pump connected in fluid communication with the cigarette to produce a predetermined series of simulated smoking puffs.

The step of applying the predetermined load to the filter preferably includes positioning a stamp in contact with the filter and biasing the stamp to the predetermined load. The step of sensing deformation of the cigarette filter preferably includes optically sensing displacement of the stamp contacting the cigarette filter during simulated smoking of the cigarette.

DETAILED DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein; rather, applicants provide this embodiment so that this disclosure will be thorough and complete, and will fully convey the scope of the invention to those skilled in the art. Like numbers refer to like elements throughout.

Figure 1:
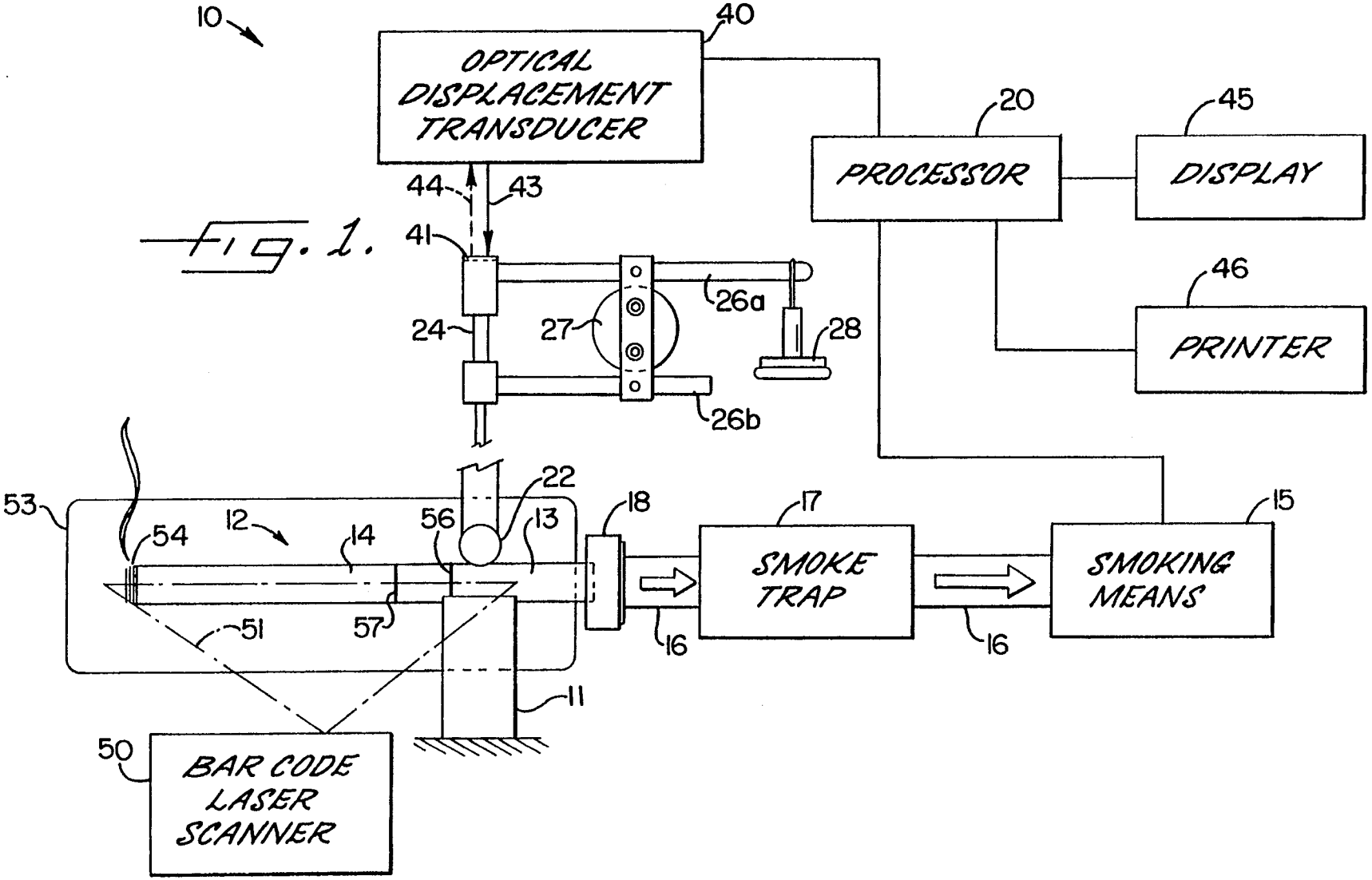
FIG. 1 is a schematic view of the test apparatus for measuring cigarette filter hot collapse and/or tobacco consumption according to the invention.

Referring to the drawings and, more particularly, to FIG. 1, the test apparatus 10 for measuring cigarette filter hot collapse and tobacco consumption according to the present invention is first described. The test apparatus 10 includes a cigarette holder 11 for holding a cigarette 12 preferably in a generally horizontal position. The cigarette 12, as would be readily understood by those skilled in the art, is of the conventional type including a filter 13 and an adjacent tobacco column or rod 14 joined together by tipping paper.

Smoking means 15 is connected to the cigarette 12 to provide simulated smoking of the cigarette. The smoking means 15 is connected in fluid communication with the cigarette 12 by tubing 16. A conventional smoke trap 17 including a filter medium may preferably be connected between the smoking means 15 and the cigarette 12. In addition, the connection between the cigarette and the tubing 16 is preferably provided by a coupler 18. The coupler 18 includes a series of labyrinth seals, not shown, as would also be readily understood by those skilled in the art.

Figure 2:
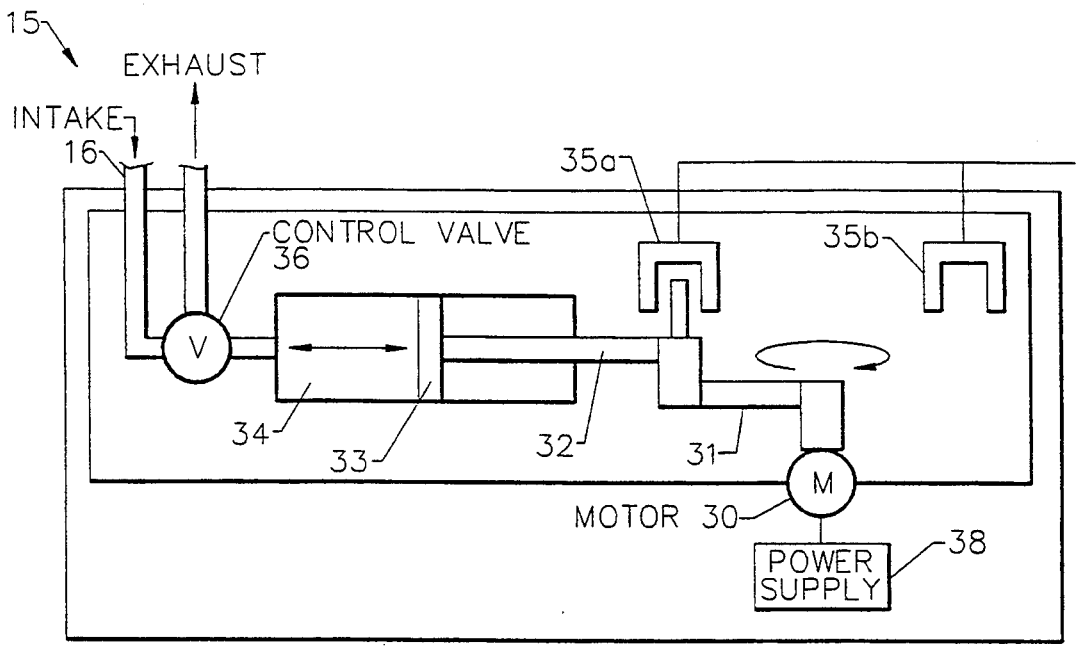
FIG. 2 is a schematic view of a smoking machine used in the test apparatus as shown in FIG. 1.

Referring briefly to FIG. 2, the smoking means 15 is preferably provided by fluid pump including a motor 30 connected by a crank arm 31 to a piston shaft 32 for reciprocally driving a piston 33 positioned within a piston chamber 34 as shown in the illustrated embodiment. A pair of optical sensors 35*a* 35*b* are associated with the crank arm 31 to facilitate control of a valve 36 to regulate exhaust and intake of air to thereby simulating smoking of the cigarette 12. The motor 30 is driven by a conventional power supply 38 under the control of a processor 20 (FIG. 1), such as a microprocessor or computer operating under stored program control.

Figure 3:
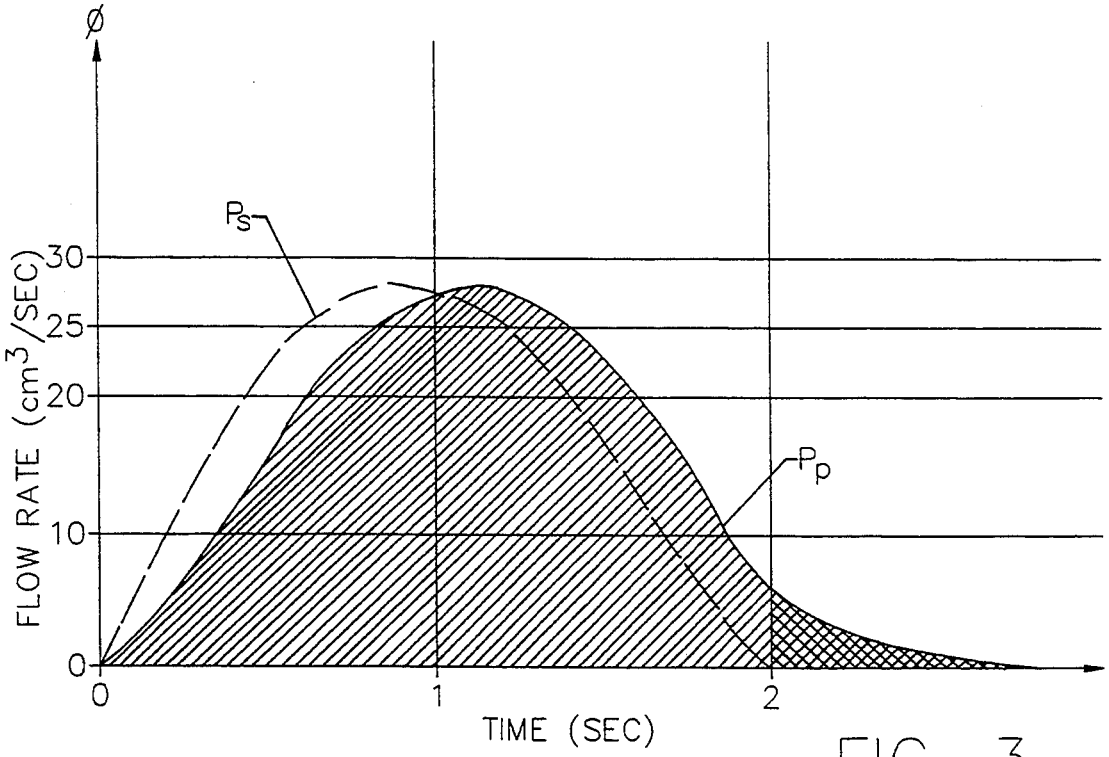
FIG. 3. (PRIOR ART)
FIG. 3 is a graphical representation of a puff profile and swept volume profile as known in the prior art and capable of being produced by the smoking machine as shown in FIG. 2.

The smoking means 15 may be operated to follow a predetermined protocol of puffs, each having a predetermined volume. For example, as shown in FIG. 3, the smoking means 15 may be operated to produce a typical bell-shaped puff profile $P_p$ as shown along with the corresponding swept profile $P_s$ of the piston 33 within the chamber 34. The puff and swept profile shown in FIG. 3 are from the CORESTA Recommended Method No. 22 entitled "Routine Analytical Cigarette-Smoking Machine: Specifications, Definitions and Standard Conditions", 1991, the entire disclosure of which is incorporated herein by reference.

The puff volume, duration and frequency may be readily controlled by appropriate sizing of the piston 33 and its swept volume within the chamber 34, along with controlling operation of the motor 30. For example, as also specified in the CORESTA Recommended Method No. B, each puff is preferably of 2.0 second duration with one puff occurring every minute. Accordingly, for a typical cigarette 12, consumption of the tobacco column or rod 14 of the cigarette takes about 8–12 minutes.

The test sample cigarette is also preferably conditioned as specified by CORESTA Method No. 21 entitled "Atmosphere for Conditioning and Testing Tobacco and Tobacco Products", 1991, the entire disclosure of which is incorporated herein by reference. The specified conditioning parameters should be followed for between two and ten days. The atmosphere during testing also preferably conforms to the CORESTA Method 21. The CORESTA Recommended Method No. 25 entitled "Ambient Air-Flow around Cigarettes in Routing Analytical Smoking Machines: Control and Monitoring", the entire disclosure of which is also incorporated herein by reference, is also preferably followed during testing.

Referring again primarily to FIG. 1, the test apparatus 10 includes hot collapse sensing means which, in the illustrated embodiment, is provided by stamp means and an optical displacement transducer 23. The stamp means provides a predetermined load transverse to the filter 13. In the illustrated embodiment, the stamp means is provided in part by a stamp 22 to which a shaft 24 is connected so that the shaft extends generally vertically above the filter 13 under test. The stamp 22 preferably has a predetermined generally cylindrical shape for bearing upon the filter 13. The stamp means also preferably includes means for supporting the shaft 24 so that the stamp 22 is movable in a vertical direction downward upon the cigarette filter 13, and bias means connected to the shaft for providing the predetermined load through the stamp and to the cigarette filter. As shown in the illustrated embodiment, a pair of arms 26*a*, 26*b* secured to a rotatable disk 27 and a counterbalance weight 28 may serve to mount and bias the stamp 22. As would be readily understood by those skilled in the art, other mounting and biasing arrangements are contemplated by the invention.

The stamp 22 may have a cylindrical shape at least about 10 mm in length and with a diameter of 6 mm as specified in the CORESTA Task Force report entitled "Determination of the 'Cigarette Hot Collapse' During Smoking" (Rev. 4) (Aug. 21, 1991), the entire disclosure of which is incorporated herein by reference. The stamp 22 may be positioned in bearing contact with the filter 13 perpendicular to its axis at a point 5 mm back from the junction between the filter 13 and the tobacco column 14 with a predetermined load of 30 grams—both parameters as specified in the above mentioned CORESTA Task Force report. The butt length and insertion depth of the cigarette 12 into the cigarette holder 11 may also be as specified in the CORESTA Recommended Method No. 22. As would be readily appreciated by those skilled in the art, other test and set up parameters may also be used.

Movement downward of the biased stamp 22 is readily determined according to the invention by a conventional optical displacement transducer 40 of the type as manufactured by Aromat Corporation of New Providence, New Jersey under the model designation LM200 Series, ANL 23345AC, cooperating with a strip of reflective tape 41 or other reflector carried by the shaft 24. The optical displacement transducer 40 includes an optical transmitter or source for generating an optical beam 43, a receiver, and means for determining relative displacement of the shaft 24, and hence of the stamp 22, based upon a portion of the optical beam 44 reflected back to the receiver of the optical displacement transducer. The optical source may be a continuous on laser as would readily be appreciated by those skilled in the art. The downward movement of the stamp 22 during simulated smoking of the cigarette 12 is indicative of the hot collapse of the cigarette.

The stamp 22 is desirably initially lowered onto the filter 13 without crushing same. Thirty seconds after applying the stamp 22, the cigarette 12 may be lit during the first puff of the smoking means 15. Typically a filter medium in the smoke trap 17 is changed every 5 cigarettes, while 10 cigarettes are tested to achieve a statistically meaningful sample size.

In order to measure tobacco consumption during simulated smoking, the test apparatus includes tobacco consumption sensing means positioned adjacent the cigarette holder 11. The tobacco consumption sensing means senses or detects relative movement of a charline along the tobacco rod 14 of the burning cigarette 12 during simulated smoking and generates a tobacco consumption signal based upon the sensed relative movement of the charline. The tobacco consumption sensing means preferably is provided by a barcode laser scanner 50 of the conventional type as available, for example, from Applied Identification Systems, Inc. of Charlotte, N.C. under the model designation LS6100. The barcode scanner 50 preferably includes laser transmitter means for generating a laser beam 51, scanning means for scanning the laser beam along a length of the cigarette 12, and receiver means for detecting a reflected portion of the scanned laser beam from the cigarette.

A shield 53 is desirably positioned on the opposite side of the cigarette holder 11 opposite the barcode laser scanner 50 to prevent the unintended or accidental viewing of the scanned laser beam 51. The laser beam 51, however, is a moving beam, as contrasted to a stationary beam which may be viewed for a longer time. In addition, the scanned laser beam 51 is also of relatively low power as would be readily understood by those skilled in the art.

As would be readily understood by those skilled in the art, the barcode laser scanner 50 operates by taking advantage of the contrasting appearance of the dark charline 54, and the contrast of a the joint 56 between the covering of the tobacco rod 14 and the tipping paper. A first indicia 57, such as an ink stripe, may also be made on the cigarette 12 to provide a reference mark for measuring relative movement of the charline 54. Of course, such a first indicia must be upstream from a point at which the smoking will be stopped. In addition, to initially calibrate the barcode laser scanner 50, a second indicia such as an ink stripe, not shown, may be made at the tip of the cigarette 12. After the cigarette 12 is lit, the charline 54 provides the needed contrast for operation of the barcode laser scanner 50. As would be readily understood by those skilled in the art, the tobacco consumption sensing means may be advantageously used in other cigarette-related testing applications.

Figure 4:
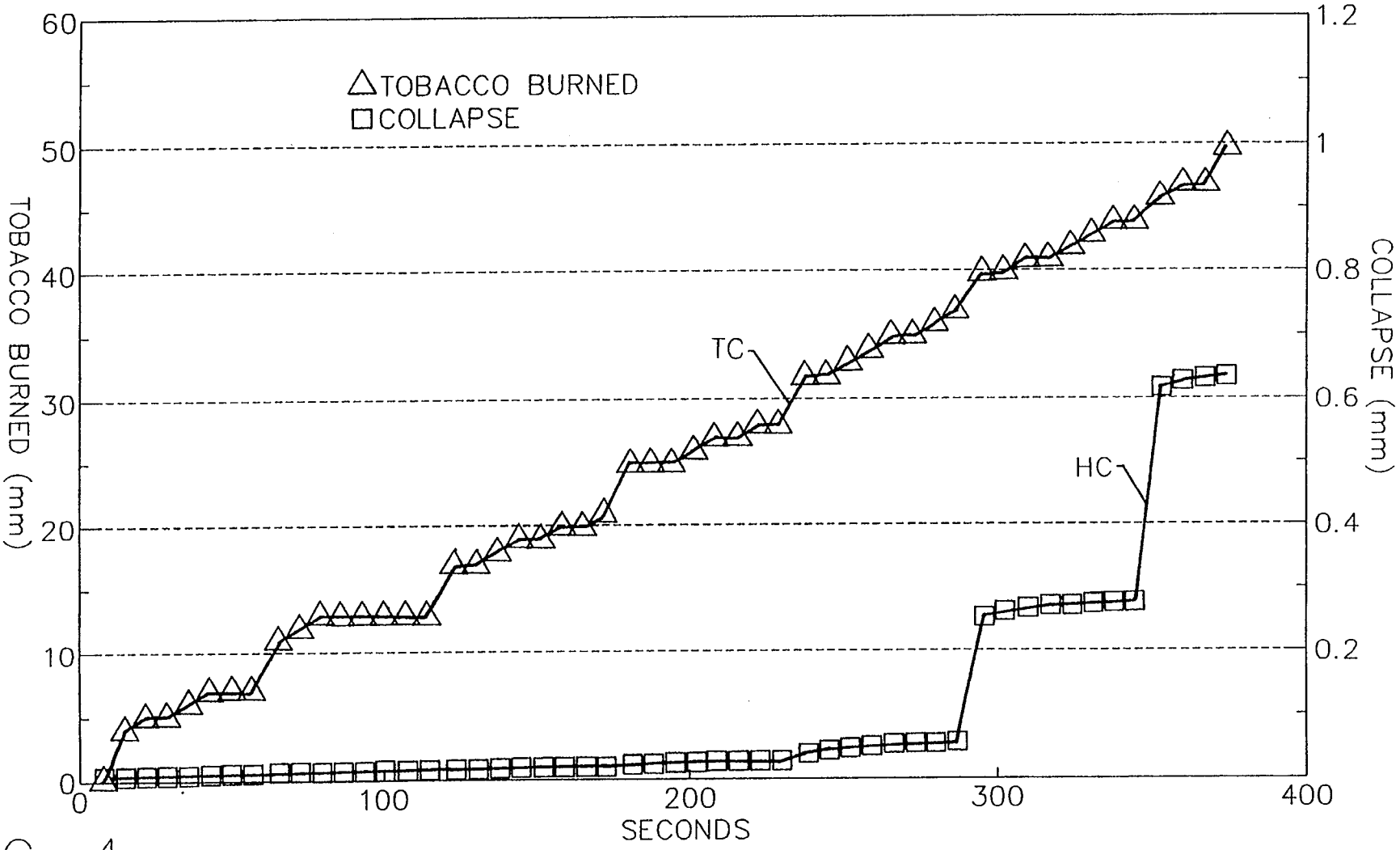
FIG. 4 is a graphical representation of measured hot collapse and tobacco consumption signals using the test apparatus according to the invention.

The processor 20 which controls the functions of the components of the test apparatus 10, may be programmed to sample the hot collapse and tobacco consumption signals to thereby generate respective data points in tabular form as would be readily understood by those skilled in the art. Moreover, the processor 20 is also desirably connected to a suitable display means 45, such as a CRT screen, for displaying respective graphical representations of the measured hot collapse and tobacco consumption signals. FIG. 4 illustrates a plot HC of measured hot collapse data points, the individual data points, in turn, being indicated by the squares. FIG. 4 also illustrates a plot TC of measured tobacco consumption data points, the data points, in turn, being indicated by the triangles. As would also be readily understood by those skilled in the art, the processor 20 may be operatively connected to a conventional printer 46 to produce printouts of the measured data in either graphical or tabular form.

The method of the present invention is for testing hot collapse of a cigarette filter 13 during simulated smoking of the cigarette 12. The method includes the steps of: positioning the cigarette in a holder 11 and drawing air through the burning cigarette to thereby simulate smoking of the cigarette; sensing deformation of the cigarette filter 13 responsive to a predetermined load applied transverse to the filter during simulated smoking of the cigarette and generating a hot collapse signal based upon the sensed deformation; and sensing relative movement of a charline 51 along a tobacco rod of the burning cigarette during simulated smoking. The relative movement of the charline 51 is sensed by generating a laser beam 51, scanning the laser beam along a length of the cigarette, and detecting a reflected portion of the scanned laser beam from the cigarette to thereby generate a tobacco consumption signal based upon the sensed relative movement of the charline 56.

The method also preferably includes the step of generating a graphical representation of at least one of the hot collapse signal and the tobacco consumption signal as a function of time.

The step of drawing air through the burning cigarette preferably includes the step of operating a pump connected in fluid communication with the cigarette to produce a predetermined series of simulated smoking puffs. Accordingly, since the smoking means 15 preferably produces the puffs in a predetermined pattern, the hot collapse and tobacco consumption signals may also be correlated to the number of puffs, as well as to elapsed time.

The step of applying the predetermined load to the filter preferably includes positioning a stamp 22 in bearing contact with the filter 13 and biasing the stamp to the predetermined load. The step of sensing deformation of the cigarette filter 13 preferably includes optically sensing displacement of the stamp 22 contacting the cigarette filter during simulated smoking of the cigarette 12.

The method also preferably includes the steps of shielding the scanned laser beam 51 with a suitable shield 53, and marking the cigarette 12 with indicia, such as ink stripes as discussed in greater detail above.

TABLE 1 below illustrates a proposed user interface screen and data input format which facilitates prompt preparation of reports regarding the collected data from the test apparatus 10 according to the invention. The quantities identified in the table are self-explanatory to those of skill in the art in view of the preceding description.

TABLE 1

| Filter Products Hot Collapse Report | |
|---|---|
| Trial Number: | XXXXXXXX |
| Test Requested By: | xxxxxxxx |
| Operator: | xxxxxxxx |
| Sample Number: | xxxxxxxx |
| Cigarette Type: | xxxxxxxx |
| Cigarette Brand: | xxxxxxxx |
| Tow Item: | xxxxxxxx |
| Plug Wrap: | xxxxxxxx |
| Tipping Paper: | xxxxxxxx |
| Tip Weight: | x.xx |
| Plasticizer Type: | xxxxxxxx |
| Plasticizer Content: | x.xx |
| PCNT Filter Ventilation: | x.xx |
| Filter Firmness: | x.xx |
| Filter Encapsulated Pressure Drop: | x.xx |
| Filter Unencapsulated Pressure Drop: | x.xx |
| Initial Filter Circumference: | x.xx |
| Stamp Weight: | 30 grams |
| Stamp Position: | 5 mm |
| Puff Interval: | 60 seconds |
| Puff Duration: | 2 seconds |
| Collect Data Every 9 Seconds | |
| Test Date/Time: | xx/xx/xx; xx:xx:xx |
| Initial Dimensions: | |
| Filter Radius: | 4 mm |
| Filter Diameter: | 8 mm |
| Filter Length: | 10 mm |
| Rod Length: | 77 mm |

The test apparatus 10 according to the invention may quickly and accurately record data for filter hot collapse and tobacco consumption as a function of elapsed test time. For example, data for each quantity may be taken and recorded every 9 seconds. The data may also be readily correlated to number of puffs as would be readily understood by those skilled in the art. The collected data may be used to adjust quantities and types of additives used in the cigarette filter, or other variables such as filament denier, filter density, or degree of filament crimp as would also be readily understood by those skilled in the art. The tobacco consumption sensing aspect of the present invention may also have application in other cigarette testing procedures. Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An apparatus for testing hot collapse of a cigarette filter during simulated smoking of a cigarette, the test apparatus comprising:

a cigarette holder;

smoking means for drawing air through a burning cigarette positioned in said cigarette holder to thereby simulate smoking of the cigarette;

hot collapse sensing means positioned adjacent said cigarette holder for sensing deformation of the cigarette filter responsive to a predetermined load applied transverse to the filter during simulated smoking of the cigarette and for generating a hot collapse signal based upon the sensed deformation; and tobacco consumption sensing means positioned adjacent said cigarette holder for sensing relative movement of a charline along a tobacco rod of the burning cigarette during simulated smoking and for generating a tobacco consumption signal based upon the sensed relative movement of the charline, said tobacco consumption sensing means comprising laser transmitter means for generating a laser beam, scanning means for scanning the laser beam along a length of the cigarette, and receiver means for detecting a reflected portion of the scanned laser beam from the cigarette.

2. A test apparatus according to claim 1 further comprising:

a processor operatively connected to said hot collapse sensing means and said tobacco consumption sensing means; and display means operatively connected to said processor for generating a graphical representation of at least one of said hot collapse signal and said tobacco consumption signal as a function of time.

3. A test apparatus according to claim 1 wherein said smoking means comprises a fluid pump and means for operating said fluid pump to produce a predetermined series of simulated smoking puffs.

4. A test apparatus according to claim 1 further comprising laser shield means positioned adjacent said cigarette holder opposite said laser transmitter means for shielding an accidental or unintended observer from the laser beam.

5. A test apparatus according to claim 1 wherein said cigarette holder comprises means for supporting an underside of the cigarette to hold same in a generally horizontal orientation.

6. A test apparatus according to claim 1 wherein said hot collapse sensing means comprises stamp means positioned adjacent said cigarette holder for providing the predetermined load transverse to the cigarette filter during simulated smoking; and wherein said stamp means comprises a stamp for contacting the cigarette filter, a shaft connected to said stamp, means for supporting said shaft so that said stamp is movable in a vertical direction downward upon the cigarette filter, and bias means connected to said shaft for providing the predetermined load through said stamp and to said cigarette filter.

7. A test apparatus according to claim 6 further comprising an optical reflector carried by said shaft; and wherein said hot collapse sensing means includes an optical displacement transducer cooperating with said reflector for generating a signal related to displacement of said reflector.

8. A test apparatus for a cigarette during simulated smoking of the cigarette, the test apparatus comprising:

a cigarette holder;

smoking means for drawing air through a burning cigarette positioned in said cigarette holder to thereby simulate smoking of the cigarette; and tobacco consumption sensing means positioned adjacent said cigarette holder for sensing relative movement of a charline along a tobacco rod of the burning cigarette during simulated smoking and for generating a tobacco consumption signal based upon the sensed relative movement of the charline, said tobacco consumption sensing means comprising laser transmitter means for generating a laser beam, scanning means for scanning the laser beam along a length of the cigarette, and receiver means for detecting a reflected portion of the scanned laser beam from the cigarette.

9. A test apparatus according to claim 8 further comprising a processor operatively connected to said tobacco consumption means, and display means operatively connected to said processor for generating a graphical representation of said tobacco consumption signal as a function of time.

10. A test apparatus according to claim 8 wherein said smoking means comprises a fluid pump and means for operating said fluid pump to produce a predetermined series of simulated smoking puffs.

11. A test apparatus according to claim 8 further comprising laser shield means positioned adjacent said cigarette holder opposite said laser transmitter means for shielding an accidental or unintended observer from the laser beam.

12. A method for testing hot collapse of a cigarette filter during simulated smoking of a cigarette, the method comprising the steps of:

positioning a cigarette in a holder and drawing air through the burning cigarette positioned in the holder to thereby simulate smoking of the cigarette;

sensing deformation of the cigarette filter responsive to a predetermined load applied transverse to the filter during simulated smoking of the cigarette and generating a hot collapse signal based upon the sensed deformation; and sensing relative movement of a charline along a tobacco rod of the burning cigarette during simulated smoking by generating a laser beam, scanning the laser beam along a length of the cigarette, and detecting a reflected portion of the scanned laser beam from the cigarette to thereby generate a tobacco consumption signal based upon the sensed relative movement of the charline.

13. A method according to claim 12 further comprising the step of generating a graphical representation of at least one of the hot collapse signal and the tobacco consumption signal as a function of time.

14. A method according to claim 12 wherein the step of drawing air through the burning cigarette comprises the step of operating a fluid pump connected in fluid communication with the cigarette to produce a predetermined series of simulated smoking puffs.

15. A method according to claim 12 further comprising the step of shielding an accidental or unintended observer from the scanned laser beam.

16. A method according to claim 12 wherein the step of applying the predetermined load to the filter comprises positioning a stamp in contact with the filter and biasing the stamp to the predetermined load; and wherein the step of sensing deformation of the cigarette filter comprises optically sensing displacement of the stamp contacting the cigarette filter during simulated smoking of the cigarette.

17. A method according to claim 12 wherein the step of sensing tobacco consumption comprises applying a first indicia on the cigarette at an end thereof before lighting the cigarette, and applying a second indicia on the cigarette upstream of a desired stopping point.

18. A method for testing a cigarette during simulated smoking of the cigarette, the method comprising the steps of:

positioning a cigarette in a holder and drawing air through the burning cigarette positioned to thereby simulate smoking of the cigarette; and sensing relative movement of a charline along a tobacco rod of the burning cigarette during simulated smoking by generating a laser beam, scanning the laser beam along a length of the cigarette, and detecting a reflected portion of the scanned laser beam from the cigarette to thereby generate a tobacco consumption signal based upon the sensed relative movement of the charline.

19. A method according to claim 18 further comprising the step of generating a graphical representation of the tobacco consumption signal as a function of time.

20. A method according to claim 18 wherein the step of drawing air through the burning cigarette comprises the step of operating a fluid pump connected in fluid communication with the cigarette to produce predetermined series of simulated smoking puffs.

21. A method according to claim 18 further comprising the step of shielding an accidental or unintended observer from the scanned laser beam.

22. A method according to claim 18 wherein the step of sensing tobacco consumption comprises applying a first indicia on the cigarette at an end thereof before lighting the cigarette, and applying a second indicia on the cigarette upstream of a desired stopping point.

* * * * *